US005596777A

United States Patent [19]

Polus

[11] Patent Number: 5,596,777

[45] Date of Patent: Jan. 28, 1997

[54] MATTRESS WITH BENT RATTAN SPRINGS

[76] Inventor: Michael Polus, Welser Str. 65, D-90489 Nürnberg, Germany

[21] Appl. No.: 503,113

[22] Filed: Jul. 17, 1995

[30] Foreign Application Priority Data

Jul. 19, 1994 [DE] Germany ..... 9411638 U

[51] Int. Cl.[6] ..... A47C 23/04; A47C 27/06

[52] U.S. Cl. ..... 5/721; 5/256

[58] Field of Search ..... 5/475, 476, 256, 5/309, 477, 478, 479, 255

[56] References Cited

U.S. PATENT DOCUMENTS

| | | | |
|---|---|---|---|
| 25,577 | 9/1859 | Newbro | 5/256 |
| Re. 34,128 | 11/1992 | Lorhpipat | 273/58 B |
| 1,561,729 | 11/1925 | Knepper | 5/477 |
| 1,915,674 | 6/1933 | Jones | 5/477 |
| 2,415,374 | 2/1947 | Schaefer | 5/256 |
| 3,740,776 | 6/1973 | Lazarus | 5/296 |
| 4,586,751 | 5/1986 | McGuire | 297/455 |

*Primary Examiner*—Alexander Grosz
*Attorney, Agent, or Firm*—Anderson, Kill, Olick, P.C.

[57] ABSTRACT

A spring mattress including a plurality of helical springs formed of rattan tubes and extending between the top and the bottom of the mattress sheath, with the helical springs forming a plurality of parallel, spaced from each other rows of helical springs, and stiffening grids provided at opposite ends of the helical springs for retaining the helical springs in their predetermined positions.

4 Claims, 1 Drawing Sheet

MATTRESS WITH BENT RATTAN SPRINGS

BACKGROUND OF THE INVENTION

The present invention relates to a spring mattress having elastic springs provided in a sheath and which are disposed in rows next to each other, and are fixed at both ends to stiffening grid, generally formed of metal.

The spiral springs of conventional spring mattresses are formed presently of steel. However, steel is rejected by some users of spring mattresses because low electrical currents can be induced therein which, in the view of these users, can have deleterious effects upon them. Instead of the spiral springs, the mattress sheath can be filled with a plastic foamed material, hair or straw, which permits to avoid the use of the electrically conducting steel. However, the special flexural effect, which is achieved by using prestressed steel helical springs is also eliminated.

Accordingly, an object of the invention is to create a spring mattress of the type described above which, while retaining the flexural effect inherent in helical springs, would not be susceptible to the inducement of an electrical current therein.

SUMMARY OF THE INVENTION

This and other objects of the invention, which will become apparent hereinafter, are achieved by forming the helical springs from bent rattan tubes made, i.e., of a rattan material. Generally, the rattan table is made of a stem of a rattan palm. The spring retaining grids may likewise be formed of an electrically non-conductive material, e.g., wood.

Rattan tubes can be bent into the shape of helical springs by using per se known technologies. The rattan tube helical springs provide a spring mattress with flexural properties which are very similar to those of helical steel springs. Rattan tubes also adapt well to the required preload. The external dimensions of the helical springs made of rattan tubes are comparable to those of helical steel springs, so that the rattan tube helical springs can be easily incorporated into conventional spring mattresses.

It is in particular expedient and advantageous, if the stiffening grids are formed of strips of a wood material. Helical springs from rattan tubes are somewhat easier to bend in the outward direction or to press sideways than helical springs from steel. Therefore, the use of stiffening grids the strips of which are subjected not only to tension but also to compression in longitudinal direction is expedient.

The helical springs are sometimes also called coil springs or flexural springs. The expression spring mattress, designate not only an elongated mattress for a bed which can be placed into a frame, but also a padding of a sofa or of an armchair which is either installed or not installed fixedly into a frame. A mat-like support layer is located, as a rule between, the helical springs and the sheath. The quantity of the Rattan tube helical springs per unit area lies within the order of magnitude of the quantity of helical steel springs per unit area. Also the quantity of the helical turns of the Rattan tube helical springs is of the same order of magnitude as the quantity of the helical turns of the helical steel springs.

Rattan tube is also called a peeled rattan tube. The rattan tube helical springs used in the inventive mattress are formed of peeled or unpeeled rattan tubes. The rattan tube is available for instance as a solid tube with a round cross section having a diameter of 8–25 mm. The rattan tube can however be also a half tube, which is obtained by cleaving the solid tube in the middle and whose smaller cross sectional dimension or "half the diameter" lies between 8–25 mm. The diameter of the steel wire of the helical steel springs is approximately 2 mm.

The rattan tube helical spring can be produced, for instance, by softening the rattan tube in water, by coiling it in the softened state upon a core and leaving it to dry in that state. In another type of manufacture, the rattan tube is heated with hot gas, is coiled in the heated state upon a core and is left to cool.

The sheath for the helical springs and the stiffening grids may be formed, e.g., so that each helical spring is located in a closed sack formed of a textile material. The sacks are generally arranged adjacent to each other and are connected with each other, e.g., hooked to each other. The sacks and their connections define the stiffening grids to which the springs are attached at their opposite ends. It is also possible to form the outer turns of the springs as rings, and to connect the so formed rings of the adjacent springs together to obtain a desired stiffening grid.

The rattan tube helical springs, as a rule, are fitted into the spring mattress in a preloaded condition, whereby idle displacement of the springs and the non-uniformity of the spring forces are eliminated. However, the rattan tube springs, if appropriately formed, can be used in a spring mattress without preloading. The preloading is provided when the spring-containing sacks are made sufficiently short. When the rattan tube springs are formed so that their outer turns are formed as rings, which are connected with each other, then tensioning threads extending in the axial direction of the helical springs are provided to effect preloading.

BRIEF DESCRIPTION OF THE DRAWINGS

The objects and features of the present invention will become more apparent, and the invention itself will be best understood from the following detailed description of the preferred embodiment, when read with reference to the accompanying drawings, wherein.

DETAILED DESCRIPTION OF THE PREFERRED EMBODIMENT

Figure 1:
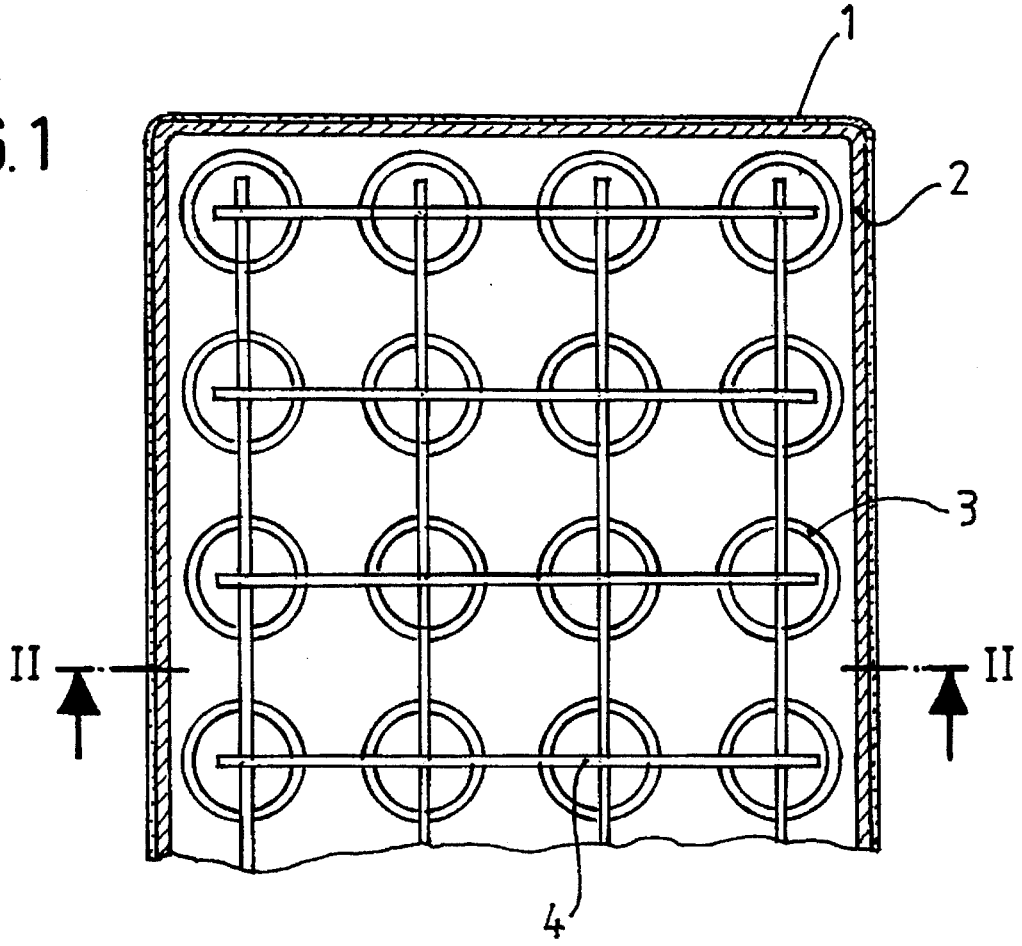
FIG. 1—a plan view of a spring mattress according to the present invention, with the sheath top being removed.
Figure 2:
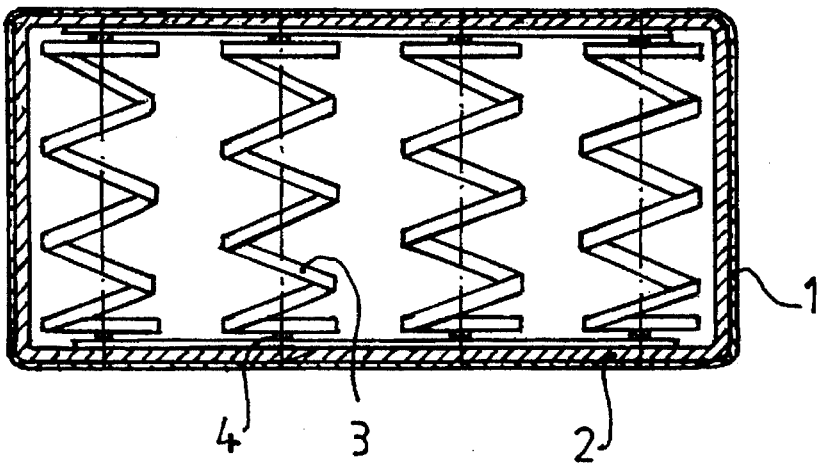
FIG. 2—is a cross-sectional view along line II—II in FIG. 1.

A spring mattress according to the present invention, which is shown in the drawings has a rectangular shape and includes a sheath 1 having a closed, clothe-like mat-like support layer 2. In the sheath 1, there are provided four extending parallel to each other rows of helical springs 3 extending between the top and the bottom of the sheath. The springs 3 are retained in a slightly compressed state by the top and the bottom of the sheath 1, being thus in a prestress condition. As discussed above, the helical springs 3 are formed of bent rattan tubes. At its opposite ends, the helical springs 3 are secured to stiffening grids 4, which are formed of a wood material.

Though the present invention was shown and described with reference to a preferred embodiment, various modifications thereof will be apparent to those skilled in the art, and it is not intended that the invention be limited to the disclosed embodiment and/or details thereof, and departures may be made therefrom within the spirit and scope of the invention, as defined in the appended claims.

What is claimed is:

1. A spring mattress, comprising:

a sheath;

a plurality of helical springs extending between top and bottom of said sheath and forming a plurality of parallel spaced from each other rows of helical springs;

two stiffening grids provided at opposite ends of said helical springs for retaining said helical springs in a predetermined position;

wherein said helical springs are formed of bent rattan tubes.

2. A spring mattress according to claim 1, wherein said stiffening grids are formed of an electrically non-conductive material.

3. A spring mattress according to claim 2, wherein said non-conductive material is a wood material.

4. A spring mattress according to claim 1, wherein said helical spring are held in said sheath in a preloaded condition.

* * * * *